United States Patent [19]

Park

[11] Patent Number: 5,074,079

[45] Date of Patent: Dec. 24, 1991

[54] AUTOMATIC ADJUSTING DEVICE FOR REVOLUTION SPEED OF ROTARY TABLE OF GLASS EDGE CHAMFERING MACHINE

[76] Inventor: Kyung Park, 305-1109 Jugong Apt. 670 Daichi-Dong, Kangnam-Ku, Seoul, Rep. of Korea

[21] Appl. No.: 550,718

[22] Filed: Jul. 9, 1990

[30] Foreign Application Priority Data

Jul. 12, 1989 [KR] Rep. of Korea ..... 10142/1989[U]

[51] Int. Cl.[5] ..... B24B 51/00

[52] U.S. Cl. ..... 51/165.77; 51/105 EC; 51/283 E

[58] Field of Search ..... 51/103 R, 103 WH, 105 R, 51/105 EC, 165, 77, 283 R, 283 E

[56] References Cited

FOREIGN PATENT DOCUMENTS 0112702 8/1980 Japan ..... 51/283 E

*Primary Examiner*—M. Rachuba
*Assistant Examiner*—Eileen Morgan
*Attorney, Agent, or Firm*—Brooks & Kushman

[57] ABSTRACT

An automatic adjusting device for the revolution speed of the rotary table of a glass plate chamfering machine is disclosed. The device of the present invention is capable of adjusting the revolution speed of the rotary table to a slower or faster speed in accordance with the shape of the glass plate mounted on the rotary table. In addition to the conventional first speed adjusting means for adjusting the speed of the rotary table in accordance with the chamfering angle and the chamfering width of the glass plate, and to the conventional second speed adjusting means for performing adjustments in accordance with the size of the glass plate, the present invention adds third speed adjusting means for performing adjustments in accordance with the shape of the glass plate.

2 Claims, 10 Drawing Sheets

PRIOR ART

PRIOR ART

AUTOMATIC ADJUSTING DEVICE FOR REVOLUTION SPEED OF ROTARY TABLE OF GLASS EDGE CHAMFERING MACHINE

FIELD OF THE INVENTION

The present invention relates to an automatic adjusting device for the revolution speed of the rotary table of glass edge chamfering machine, in which the revolution speed of the rotary table for mounting a plate glass is automatically adjusted in accordance with the shape of the plate glass so as for the processing speed to be maintained at a constant level in a glass edge chamfering machine for smoothly finishing the cut edges of the glass plate.

BACKGROUND OF THE INVENTION

A glass edge chamfering machine is operated in such a manner that a glass plate is mounted on a rotary table of the main body of the machine, the rotary table is slowly rotated, and a diamond abrasive grinding wheel revolving at a high speed is contacted to the out edge of the glass plate, thereby finishing the cut edges of the glass plate to a smooth form. However, if the revolution speed of the rotary table is too high, the wearing of the diamond abrasive grinding wheel is too severe, as well as possibly breaking the glass plate, while, if the revolution speed of the rotary table is too low, the productivity drops.

Therefore, in the conventional device, as shown in FIGS. 1 and 2, a securing shaft 3*a* is installed on the top of a vertical pole 3 which is mounted to a main body 1, while a sector gear 20 is installed to the securing shaft 3*a*. Further a fixed plate 19 is attached above a first joint beam 4 which is connected through a rotary cylinder 18 to the sector gear 20, while the sector gear 20 is let to be meshed with a pinion gear 21 on which a second speed adjusting device 22 is installed.

This second speed adjusting device 22 and a first speed adjusting device 17 which is installed at a side of the joint beam 4 are connected to a reduction motor which is installed within the main body 1 and which is for rotating the rotary table 2. In this way, the volume of the first speed adjusting device 17 is adjusted so as for it to be fit to the chamfering angle and the chamfering width. Further, the revolution speed of the rotary table 2 is secondarily adjusted by utilizing the angle variation of the first joint beam 4 and the vertical pole 3 which can be adjusted in accordance with the size of the glass plate.

However, such a chamfering machine is suitable only for circular glass plates, because the revolution speed of the rotary table 2 is adjusted in accordance with the chamfering angle, the chamfering width and the size of the glass plates, to be chamfered. Accordingly, this chamfering machine is not suitable for glass plates having an elliptical or rectangular contour or other irregular contours which show irregular distances between the centre of the glass plate and its peripheral edges.

That is, as shown in FIG. 3, it is assumed that there are a circular glass plate 23 having a diameter of 1,000 mm, a rectangular glass plate 24 having edge lengths of 500 mm and 1,000 mm, and an elliptical glass plate 25 having cross lengths of 500 mm and 1,000 mm. All these glass plates are mounted on the rotary table 2, and imaginary divisions are made at angular intervals of degrees from the centre. Then it can be observed as follows.

That is, the circular glass plate 23 shows uniform intervals at its peripheries, and therefore, the speed adjustment is possible only by means of the first and second speed adjusting devices 17,22. However, in the case of the elliptical glass plate 25, the interval shows the minimum length at the point A, and, as advancing in the clockwise direction, the intervals a–j are gradually extended, until the interval becomes the maximum at the point B. After passing the point B, the intervals are gradually shortened, while, after passing the point C, the intervals are again gradually expanded, until it reaches the point D where the maximum interval is seen. Again, after passing the point D, the intervals are gradually shortened, until it reaches the point E where the minimum interval is encountered.

Accordingly, when an elliptical or rectangular glass plate 24 or 25 is chamfered, the processing advancing distance per unit of time becomes variable, and therefore, the finishing becomes crude, and the chamfering width becomes non-uniform. In a severe case, the diamond abrasive grinding wheel is worn out very easily, or the glass plate is broken.

SUMMARY OF THE INVENTION

The present invention is intended to overcome the above described disadvantages of the conventional glass plate chamfering machines.

Therefore it is the object of the present invention to provide an automatic adjusting device for the revolution speed of the rotary table of a glass plate chamfering machine, in which the finishing distance per unit of time is made always uniform through the adjustment of the revolution speed of the rotary table, by providing a third speed adjusting device capable of rotating a bracket in accordance with the shape of the glass plate during a chamfering work, in such a manner that two third speed adjusting devices respectively 3 having a pinion gear at the end of a second joint beam and connected to a revolution shaft of a bracket are installed at the opposite sides, and a sector gear is installed on the top of the revolution shaft of the bracket so as for it to be meshed with the pinion gear.

BRIEF DESCRIPTION OF THE DRAWINGS

The above object and other advantages of the present invention will become more apparent by describing in detail the preferred embodiment of the present invention with reference to the attached drawings in which.

DESCRIPTION OF THE PREFERRED EMBODIMENT

Figure 4:
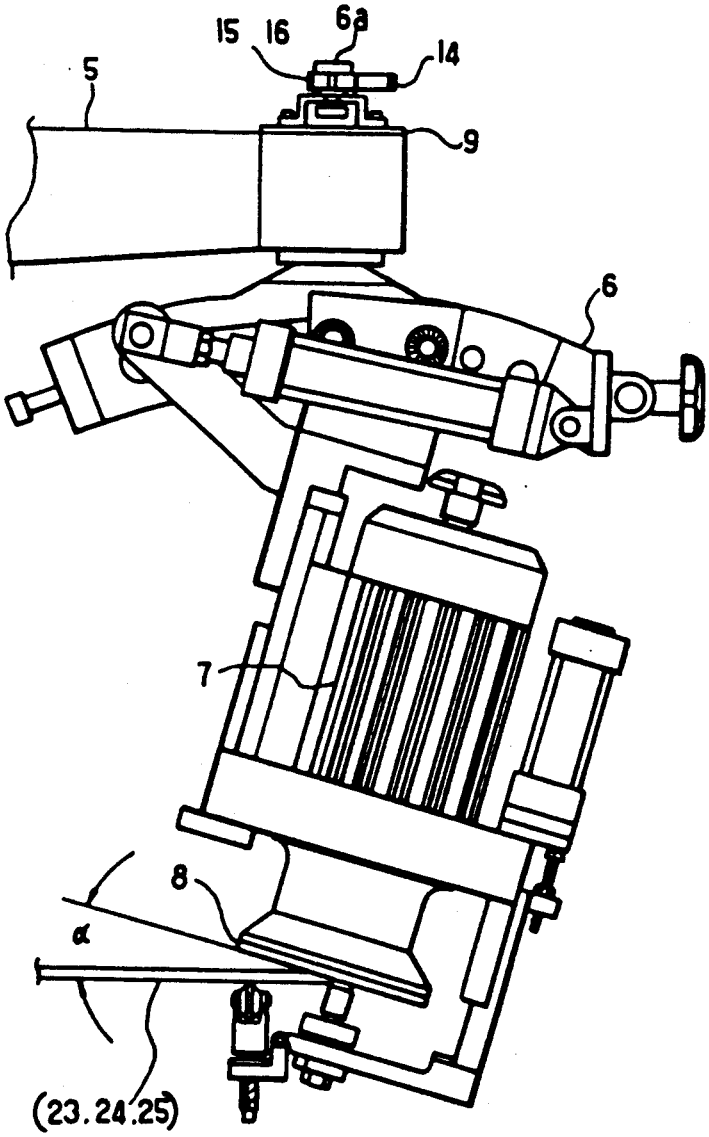
FIG. 4 is a side view of the device of the present invention.
Figure 5:
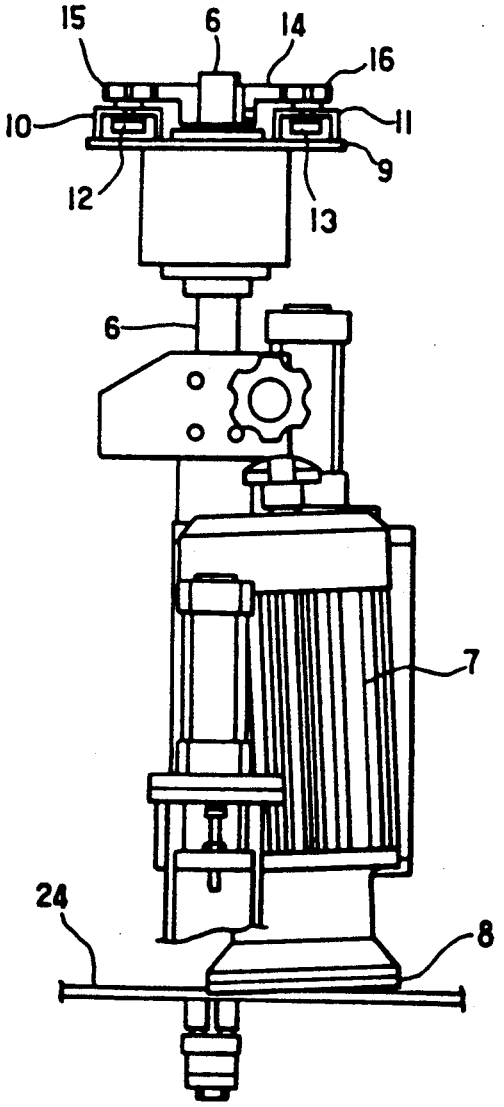
FIG. 5 is a frontal view of the device of the present invention.
Figure 13:
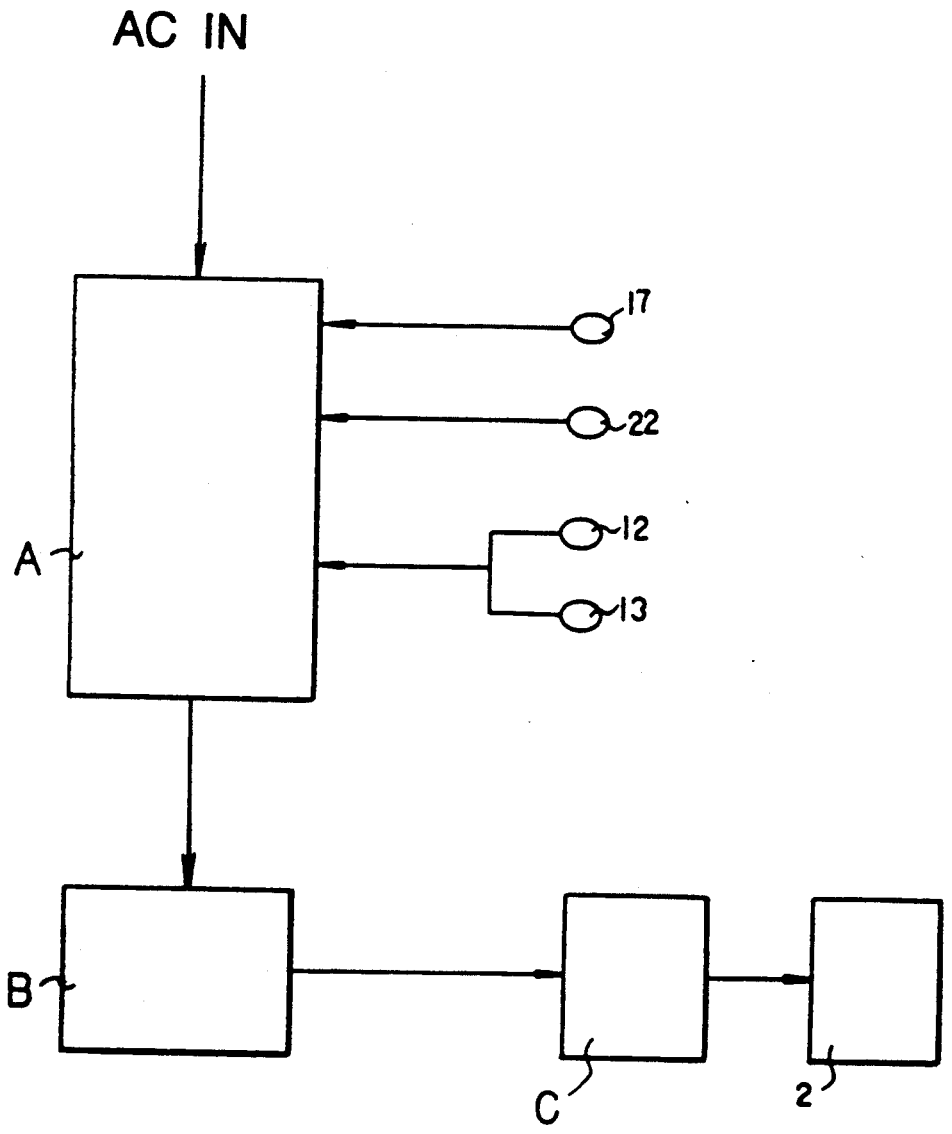
FIG. 13 is a block diagram for the operations of the device of the present invention.

The device of the present invention is constituted such that a second joint beam 5 is connected to a first joint beam 4 and a vertical pole 3 mounting first and second speed adjusting devices 17,22; and a diamond abrasive grinding wheel motor 7 is installed to the second joint beam 5 by means of a bracket 6, and is characterized in that: as shown in FIGS. 4 to 6, a sector gear is secured to the top of a revolution shaft 6*a* of the bracket 6 which is coupled with the end of the second joint beam 5; at the opposite sides of the revolution shaft 6*a*, there are installed third speed adjusting devices 12,13 respectively enclosed within two protecting caps 10,11 which are secured by means of securing plates 9; pinion gears 15,16 are installed to the projected shafts of the third speed adjusting devices 12,13 in such a manner that the pinion gears 15,16 should be meshed with the sector gear 14; and a motor revolution speed controller A which is stored within the main body of the machine is connected to the third speed adjusting devices 12,13 as shown in FIG. 13.

Reference code B indicates a reduction motor, and C indicates a reduction mechanism.

The device of the present invention constituted as above will now be described as to its operations.

In a state with a glass plate 24 mounted upon the rotary table 2, and in a state with the first speed adjusting device 17 adjusted, if the revolving diamond abrasive grinding wheel 8 is contacted to the glass plate 24, then, as in the case of the conventional device, the second speed adjusting device 22 can be adjusted in accordance with the angle variations of the vertical pole 3 and the first joint beam 4, so that the revolution speed of the rotary table 2 should be automatically adjusted in accordance with the size of the glass plate 24.

However, according to the present invention, the third speed adjusting devices 12,13 are adjusted in accordance with the state of the contact between the diamond abrasive grinding wheel 8 and the glass plate 24 so that the revolution speed of the rotary table 2 should be adjusted in accordance with the shape of the glass plate 24.

Figure 1:
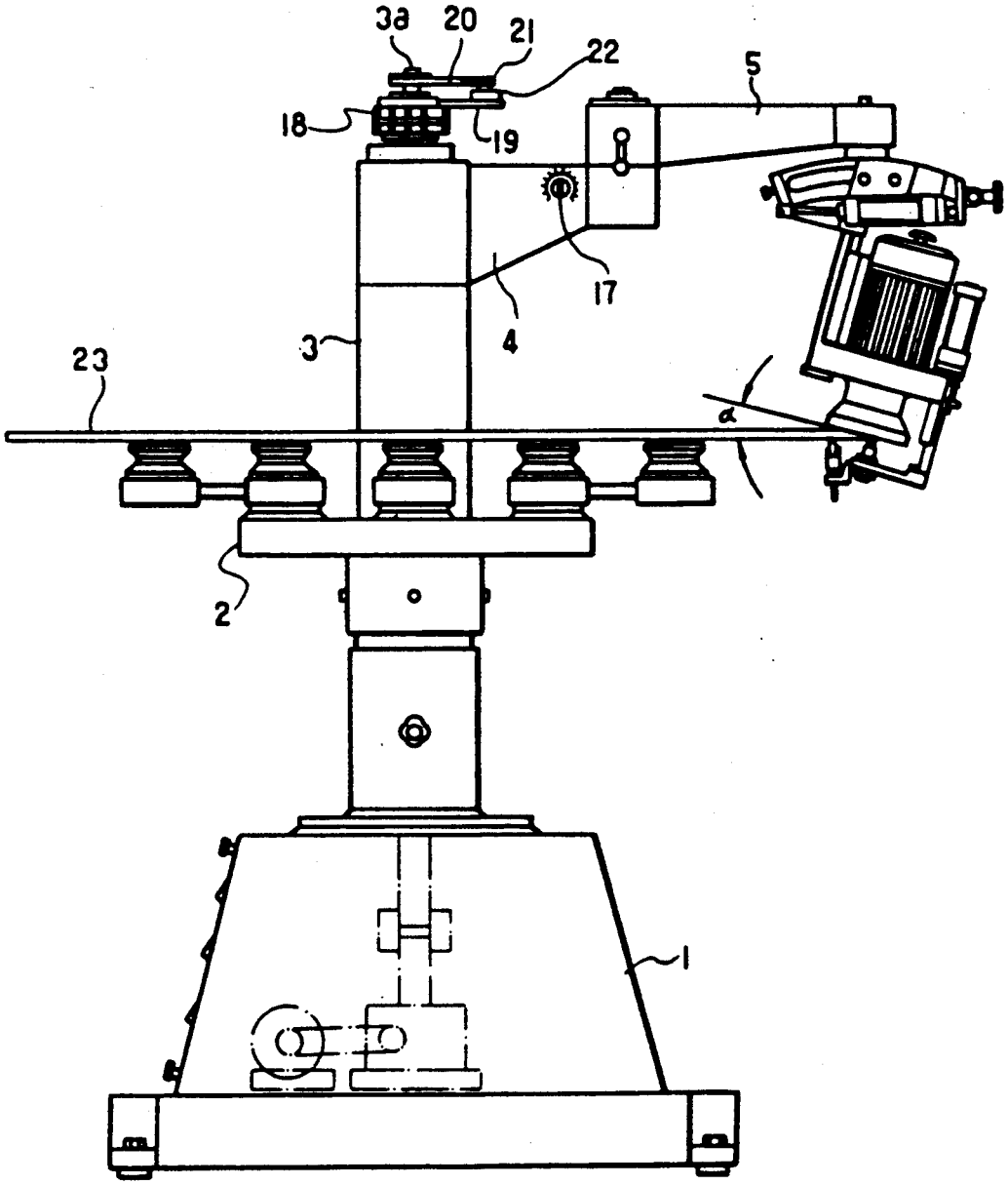
FIG. 1 is a frontal elevational view of the conventional glass plate chamfering machine.
Figure 2:
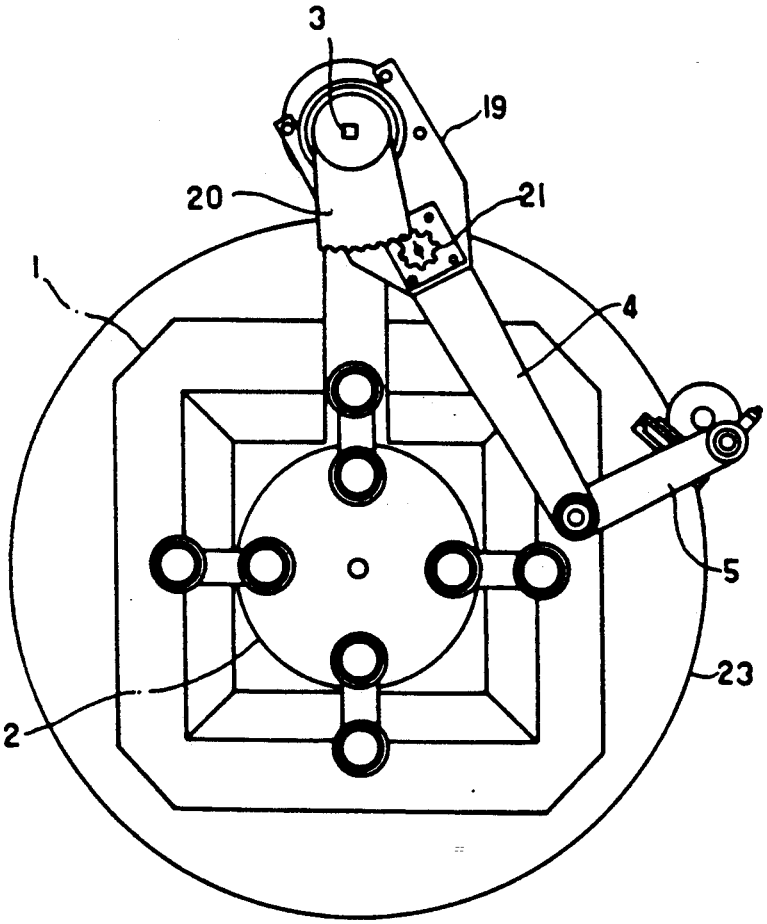
FIG. 2 is a plan view of the machine of FIG. 1.
Figure 3:
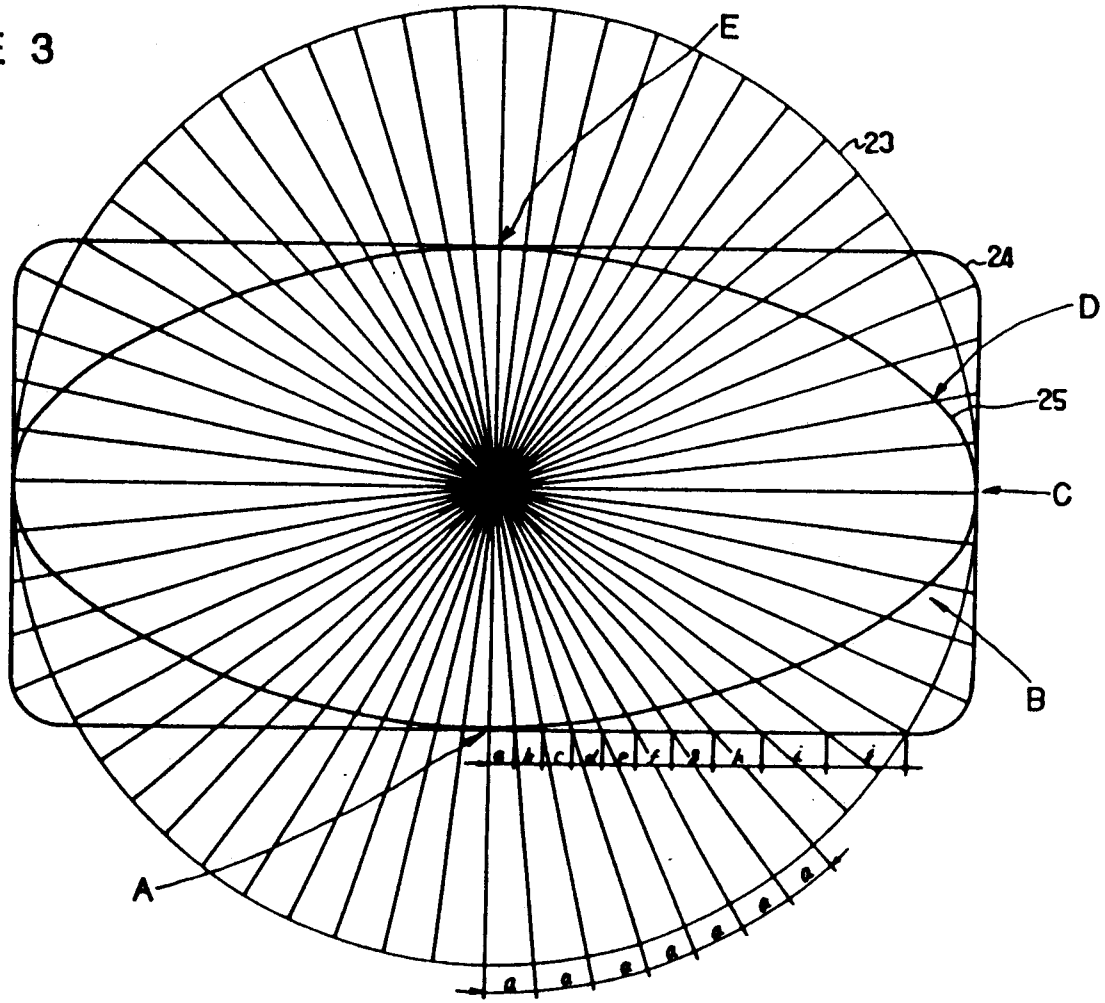
FIG. 3, is a plan view of glass plates, showing the chamfering distances for the differently shaped glass plates.

This will be described in further detail below. That is, in the case where an elliptical glass plate 25 as shown in FIG. 3 is to be chamfered, if the chamfering is advanced from the point A to the point B, the distances a–j to be chamfered per unit of time are increased as described above, and in this context, the chamfering face and the state of the contact of the diamond abrasive grinding wheel are deviated from the normal position.

More specifically, the vertical axis of the diamond abrasive grinding wheel has to be disposed in correspondence with the line normal to the chamfering face, and the horizontal axis of the diamond abrasive grinding wheel has to be disposed in parallel with the chamfering face, while the vertical axis of the diamond abrasive grinding wheel has to be disposed at the exact centre of the chamfering face of the glass plate. But these conditions can not be met in the case of the elliptical glass plate.

Therefore, Korean Utility Model Application No. 88-22093 (which is filed by the present applicant and entitled "Automatic Adjusting Device For the State of The Contact Between A Glass Plate Chamfering Face and A Diamond abrasive grinding Wheel of A Glass Plate Chamfering Machine") discloses a device which is capable of automatically adjusting the above described state, and its operating principle is such that a bracket 6 mounting a diamond abrasive grinding wheel motor 7 is automatically turned in accordance with the chamfering face of the glass plate.

Figure 6A:
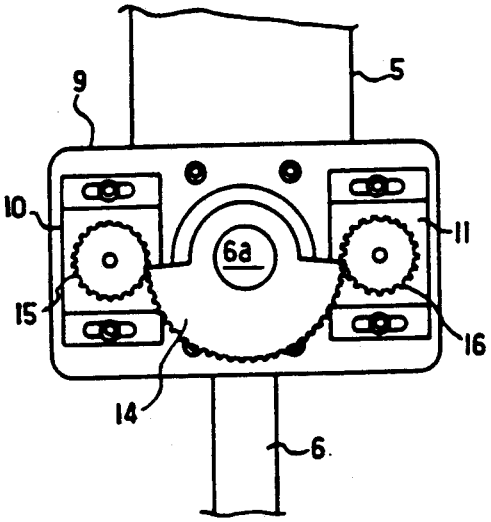
FIGS. 6*a–c* is a plan view showing the operating states of the device of the present invention.
Figure 6B:
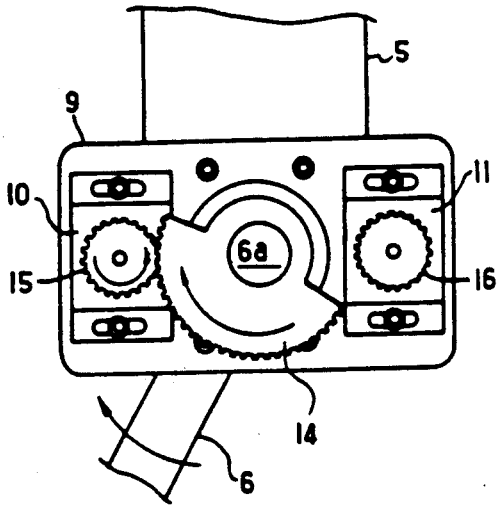
Figure 6C:
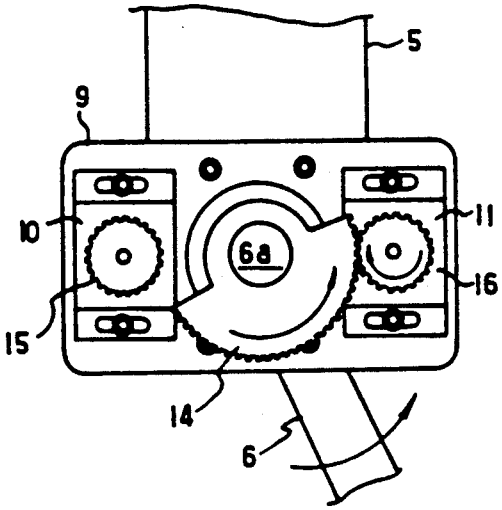

Thus, if the bracket 6 is turned in order to adjust the state of contact between the diamond abrasive grinding wheel and the chamfering face of the glass plate then the sector gear 14 and the shaft 6*a* of the bracket 6 are also turned, so that the third speed adjusting device 12 should be turned, thereby adjusting the revolution speed of the rotary table based on the principle shown in FIG. 6. That is, referring to FIG. 6A, there is shown a state in which none of the two pinions 15,16 is actuated by the setor gear 14, while FIG. 6B illustrates a state in which the bracket 6 is turned clockwise so that the sector gear 14 should drive only the pinion gear 15, thereby adjusting the revolution speed of the rotary table. Meanwhile, FIG. 6C illustrates a state in which the bracket 6 is turned anti-clockwise so that only the pinion gear 16 should be driven, thereby adjusting the revolution speed of the rotary table.

Figure 7A:
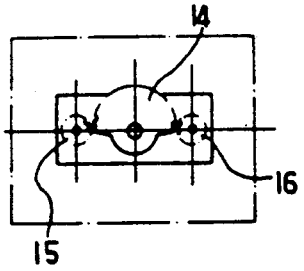
FIGS. 7 to 12*d* are schematical views showing the meshes between the sector gear and the pinion gear at different steps in accordance with the shape of the glass plate.
Figure 7:
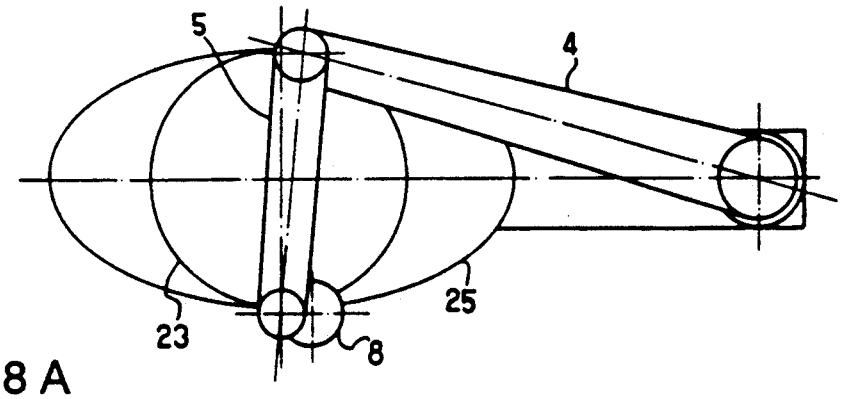

To describe the operation more in detail, when the diamond abrasive grinding wheel works at the point A, the sector gear 14 drives none of the pinion gears 15,16 as shown in FIGS. 7 and 7A.

Figure 8A:
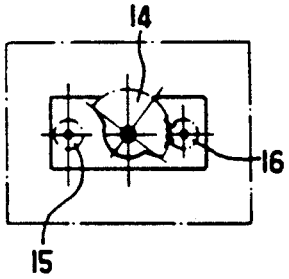
Figure 8:
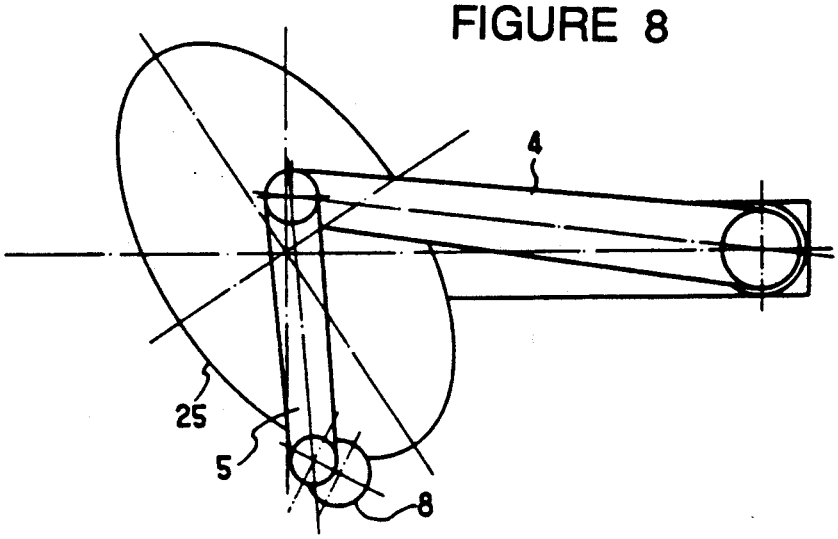
Figure 9A:
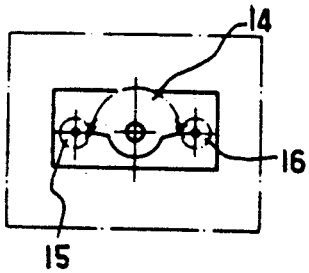
Figure 9:
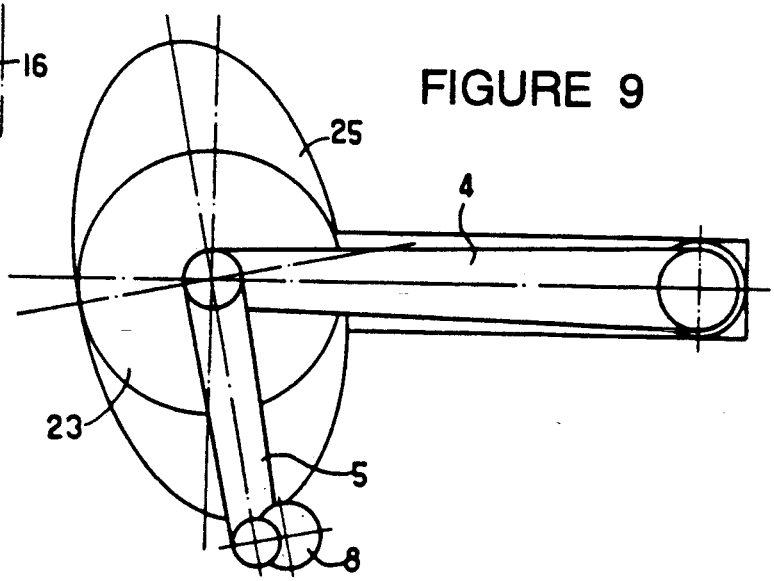
Figure 10A:
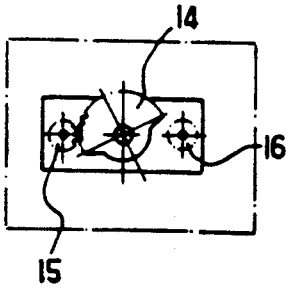
Figure 10:
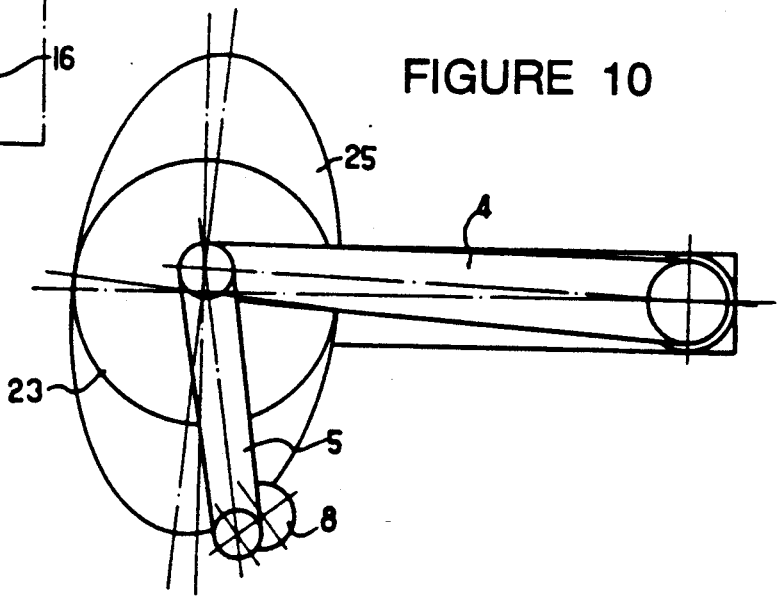
Figure 11:
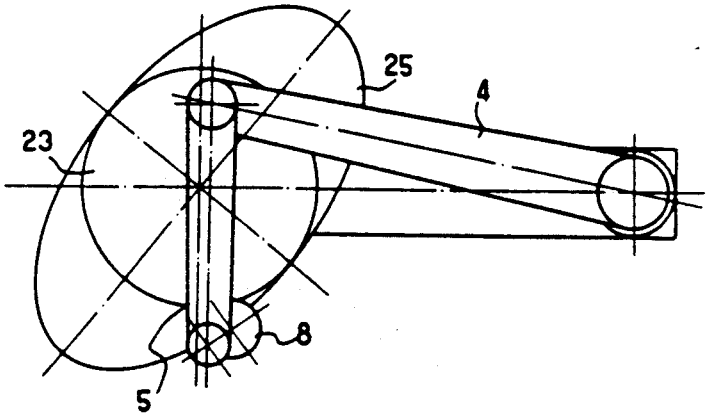
Figure 11A:
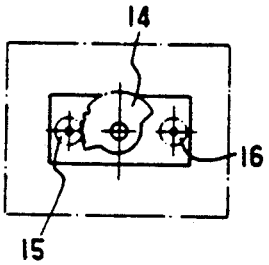
Figure 12:
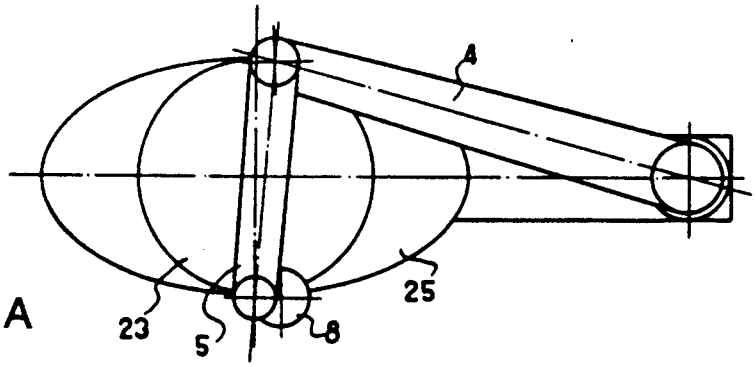
Figure 12A:
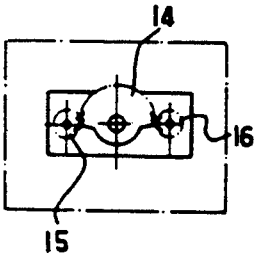

Under this condition, if the glass plate is revolved clockwise, the bracket 6 is revolved little by little owing to the function of a contact state adjusting device (not shown) for adjusting the contact state between the diamond abrasive grinding wheel and the chamfering face of the glass plate. Accordingly, the sector gear 14 is also gradually revolved in the clockwise direction, so that only the pinion gear 16 should be revolved, and that the revolution of the rotary table should become gradually slow. Such an operation is continued until the chamfering reaches the point B of FIG. 3B, and thereupon, the operating state of the sector gear 14 and the pinion gear 16 becomes as shown in FIGS. 8 and 8A. Thereafter, when the chamfering is done in the segment between the point B and the point C, the bracket 6 is revolved in the opposite direction little by little until the sector gear 14 is restored to the original position at the point C as shown in FIGS. 9 and 9A.

Under this condition, the revolution speed of the rotary table is adjusted only in accordance with the size of the glass plate.

If the glass plate 25 is further revolved, and if the chamfering is done in the segment between the point C and the point E (which corresponds to the segment between the point A and the point C of FIG. 3), then the bracket 6 is revolved anticlockwise little by little, and therefore, the sector gear 14 is shifted to rotate the pinion gear 15 so that the revolution speed of the rotary table should become gradually fast. Under this condition also, the advance speed of the chamfering becomes slowest at the moment when the chamfering passes the point D, and therefrom, the advancing speed become gradually faster when advancing toward the point E, until the chamfering reaches the point E at which the chamfering advances at the fastest speed.

Therefore, the operator has only to adjust to the optimum state of the contact state between the glass plate 24 and the diamond abrasive grinding wheel 8 in accordance with the shape of the glass plate 24 during the chamfering work, so that the chamfering advance speed per unit of time should remain constant regardless of the shape of the glass plate.

According to the present invention as described above, a sector gear 14 is secured to the top of the revolution shaft 6*a* of the bracket 6, and a pair of the pinion gears 15,16 are installed in mesh with the sector gear 14 at the opposite sides thereof, so that the revolution speed of the rotary table 2 should be automatically adjusted owing to the revolution of the shaft 6*a* of the bracket 6 in accordance with the adjustment of the contact angle of the diamond abrasive grinding wheel 8. Thus, according to the present invention, the first manual speed adjusting device 17 adjusts in accordance with the chamfering angle and the chamfering width of the glass plate, the second speed adjusting device 22 adjusts in accordance with the size of the glass plate, and the third speed adjusting devices 12,13 adjust in accordance with the shape of the glass plate in an automatic manner. Therefore, the chamfering advance per unit of time becomes constant for any glass plate of any shapes, with the result that the chamfered face becomes fine, and the chamfered width becomes uniform. Therefore, the product quality is improved, and the productivity is also improved because the conventional manual adjustment is replaced with an automatic adjustment.

What is claimed is:

1. In a glass plate chamfering machine for glass plates of circular and non-circular shapes, comprising: components including a main body; a pole secured to said main body; a second joint beam secured to said pole; and a bracket connected through a revolution shaft to said second joint beam, said components being arranged so as to adjust the contact angle of a grinding wheel with respect to the glass plate, an automatic adjusting device for the revolution speed of the glass plate, said device having a rotary table rotatable by a motor having a motor revolution speed controller; a sector gear pivotable by said revolution shaft; two third speed adjusting devices installed on shafts at the opposite sides of said sector gear, said third speed adjusting devices being connected to the motor revolution speed controller and being operable by said sector gear to adjust the speed of the motor; and two pinion gears respectively installed to the shafts of said third speed adjusting devices in mesh with said sector gear, said revolution shaft being operable through said grinding wheel and said bracket in response to the non-circular shape of a glass plate to pivot the sector gear for operating the third speed adjusting devices to adjust the revolution speed of said rotary table automatically in accordance with the non-circular shape of the glass plate.

2. A glass plate chamfering machine comprising means for rotatably supporting a glass plate of circular or non-circular shape, means for rotating the supporting means at variable speeds, grinding wheel means positioned on an edge of the glass plate at an angle predetermined by the desired chamfer; and means for adjusting the speed of the rotating means in response to the non-circular shape of the plate as sensed by the position of the grinding wheel on the edge of the plate.

* * * * *